US006325225B1

(12) United States Patent
Druitt et al.

(10) Patent No.: US 6,325,225 B1
(45) **Date of Patent: *Dec. 4, 2001**

(54) TAMPER EVIDENT CLOSURE

(75) Inventors: Rodney Malcolm Druitt, Rutland (GB); Charles Martin Tansey, Penshurst (AU)

(73) Assignee: Closures and Packaging Services Limited, Guernsey (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/268,324

(22) Filed: Mar. 16, 1999

Related U.S. Application Data

(6263) Continuation of application No. 08/922,453, filed on Sep. 3, 1997, which is a continuation of application No. 08/374,534, filed as application No. PCT/AU93/00352 on Jul. 14, 1993, now abandoned.

(30) Foreign Application Priority Data

Jul. 16, 1992 (AU) ..... PL3569
Nov. 18, 1992 (AU) ..... PL5933

(51) Int. Cl.[7] ..... B65D 41/34; B29C 45/40

(52) U.S. Cl. ..... 215/252; 264/334; 425/547

(58) Field of Search ..... 215/252, 256, 215/343, 344, 354, DIG. 1; 264/334, 318, 327, 328.16, 342 R, DIG. 71; 425/547, DIG. 5, DIG. 58

(56) References Cited

U.S. PATENT DOCUMENTS 2,162,711 6/1939 Hamberger .
2,162,712 6/1939 Hamberger .
2,162,752 6/1939 Schauer .

(List continued on next page.)

FOREIGN PATENT DOCUMENTS

31986/77 6/1979 (AU) .
45142/79 10/1979 (AU) .
47058/79 11/1979 (AU) .

(List continued on next page.)

*Primary Examiner*—Nathan J. Newhouse
(74) *Attorney, Agent, or Firm*—McDermott, Will & Emery

(57) ABSTRACT

A container closer (10) particularly for use on screw top containers such as carbonated beverage containers, the container closure (10) having a generally cylindrical continuous tamper evident band (11) joined by a plurality of frangible bridges (13) to the free edge of a skirt (16) of the closure (10). The band (11) has a segmented internal rib (18) which engages an external retaining flange of the container when the closure (10) is applied to the container so that on removal of the closure (10) the tamper evident band (11) remains on the container or is visually clearly damaged by removal of the closure (10) from the container. The band (11) is provided with longitudinal reinforcement by projections (25 and 28) or other areas of thickening (26) to provide the band (11) with longitudinal stiffness while still permitting it to expand over the retaining flange on the container. The rib (18) has a first annular side (21), the first annular side (21) having a compound surface comprising a radially outer frusto-conical portion (23) which assists in the molding of the rib (18) and a radially inner substantially planar portion (24) which increases the difficulty of removing the closure (10) intact from the container without rupturing the bridges joining the tamper evident band (11) from the remainder of the closure (10).

19 Claims, 8 Drawing Sheets

U.S. PATENT DOCUMENTS

| | | | | |
|---|---|---|---|---|
| 2,162,754 | | 6/1939 | Schauer . | |
| 2,367,317 | | 1/1945 | Thomas . | |
| 2,990,077 | | 6/1961 | Van Baarn . | |
| 3,032,226 | | 5/1962 | Terwilliger . | |
| 3,109,547 | | 11/1963 | Wood . | |
| 3,142,402 | | 7/1964 | Fox . | |
| 3,145,869 | | 8/1964 | Ritzenhoff . | |
| 3,259,233 | | 7/1966 | Beeman . | |
| 3,329,295 | | 7/1967 | Fields . | |
| 3,335,889 | | 8/1967 | Brümme . | |
| 3,438,528 | | 4/1969 | Fields . | |
| 3,441,161 | | 4/1969 | Van Baarn . | |
| 3,455,478 | | 7/1969 | Fields et al. . | |
| 3,463,341 | | 8/1969 | Fields . | |
| 3,673,761 | | 7/1972 | Leitz . | |
| 3,737,064 | | 6/1973 | Patel et al. . | |
| 3,750,821 | | 8/1973 | Sourbet et al. . | |
| 3,784,041 | | 1/1974 | Birch . | |
| 3,874,540 | | 4/1975 | Hidding . | |
| 3,901,404 | | 8/1975 | Feldman . | |
| 3,904,062 | | 9/1975 | Grussen . | |
| 3,927,784 | | 12/1975 | Cochrane . | |
| 3,930,588 | | 1/1976 | Coursaut . | |
| 4,033,472 | | 7/1977 | Aichinger . | |
| 4,109,814 | | 8/1978 | Rausing . | |
| 4,109,816 | | 8/1978 | Faulstich . | |
| 4,126,240 | | 11/1978 | Brach . | |
| 4,147,268 | | 4/1979 | Patel et al. . | |
| 4,165,813 | | 8/1979 | Babiol . | |
| 4,196,818 | | 4/1980 | Brownbill . | |
| 4,197,955 | | 4/1980 | Luenser . | |
| 4,225,050 | | 9/1980 | Reinhart . | |
| 4,241,842 | | 12/1980 | Toeppen . | |
| 4,278,180 | | 7/1981 | Willis . | |
| 4,299,328 | | 11/1981 | Ochs et al. . | |
| 4,305,516 | | 12/1981 | Perne et al. . | |
| 4,322,012 | | 3/1982 | Conti . | |
| 4,343,408 | | 8/1982 | Csaszar . | |
| 4,352,436 | | 10/1982 | Chartier et al. . | |
| 4,380,299 | | 4/1983 | Alejandro Llera . | |
| 4,394,918 | | 7/1983 | Grussen . | |
| 4,432,461 | | 2/1984 | Mumford et al. . | |
| 4,436,212 | | 3/1984 | Alejandro Llera . | |
| 4,461,390 | | 7/1984 | Csaszar . | |
| 4,479,586 | | 10/1984 | Csaszar . | |
| 4,503,985 | | 3/1985 | Swartzbaugh et al. . | |
| 4,526,282 | | 7/1985 | Dutt et al. . | |
| 4,529,096 | | 7/1985 | Chartier et al. . | |
| 4,552,328 | | 11/1985 | Dutt et al. . | |
| 4,557,393 | | 12/1985 | Boik . | |
| 4,572,387 | | 2/1986 | Luker et al. . | |
| 4,635,808 | | 1/1987 | Nolan . | |
| 4,655,356 | | 4/1987 | Fuchs . | |
| 4,664,279 | | 5/1987 | Obrist et al. . | |
| 4,667,838 | | 5/1987 | Yeager . | |
| 4,682,700 | | 7/1987 | Montgomery et al. . | |
| 4,770,306 | | 9/1988 | Szczesniak . | |
| 4,805,792 | | 2/1989 | Lecinski, Jr. . | |
| 4,806,301 | * | 2/1989 | Conti . | |
| 4,878,589 | * | 11/1989 | Webster et al. | 215/252 |
| 4,890,754 | | 1/1990 | Dorn et al. . | |
| 4,899,898 | | 2/1990 | Thompson . | |
| 4,913,300 | | 4/1990 | Wiedmer et al. . | |
| 4,997,097 | | 3/1991 | Krautkrämer . | |
| 5,050,753 | * | 9/1991 | Trump et al. | 215/252 |
| 5,131,550 | * | 7/1992 | Thompson | 215/252 |
| 5,167,335 | * | 12/1992 | McBride et al. | 215/252 |
| 5,215,204 | | 6/1993 | Beck et al. . | |
| 5,230,856 | | 7/1993 | Schellenbach . | |
| 5,246,125 | | 9/1993 | Julian . | |
| 5,423,444 | * | 6/1995 | Druitt | 215/344 |
| 6,089,390 | * | 7/2000 | Druitt et al. | 215/252 |

FOREIGN PATENT DOCUMENTS

| | | |
|---|---|---|
| 51954/79 | 5/1980 | (AU) . |
| 66169/81 | 8/1981 | (AU) . |
| 67170/81 | 8/1981 | (AU) . |
| 78506/81 | 7/1982 | (AU) . |
| 89509/82 | 3/1983 | (AU) . |
| 14180/83 | 11/1983 | (AU) . |
| 16597/83 | 1/1984 | (AU) . |
| 14451/83 | 11/1984 | (AU) . |
| 32652/84 | 3/1985 | (AU) . |
| 22256/83 | 6/1985 | (AU) . |
| 43262/85 | 12/1985 | (AU) . |
| 38985/85 | 1/1986 | (AU) . |
| 39567/85 | 1/1986 | (AU) . |
| 44690/85 | 1/1986 | (AU) . |
| 56786/86 | 11/1986 | (AU) . |
| 65114/86 | 2/1987 | (AU) . |
| 66137/86 | 8/1987 | (AU) . |
| 68160/87 | 8/1987 | (AU) . |
| 67407/87 | 10/1987 | (AU) . |
| 74092/87 | 12/1987 | (AU) . |
| 17123/88 | 2/1988 | (AU) . |
| 61581/86 | 2/1988 | (AU) . |
| A-21712/88 | 3/1989 | (AU) . |
| B-21712/88 | 3/1989 | (AU) . |
| 29156/89 | 7/1989 | (AU) . |
| 37737/89 | 1/1990 | (AU) . |
| 41081/89 | 3/1990 | (AU) . |
| 50553/90 | 6/1990 | (AU) . |
| 48910/90 | 8/1990 | (AU) . |
| 49184/90 | 8/1990 | (AU) . |
| 52154/90 | 9/1990 | (AU) . |
| 54892/90 | 9/1990 | (AU) . |
| 58969/90 | 1/1991 | (AU) . |
| 60823/90 | 2/1991 | (AU) . |
| 64205/90 | 4/1991 | (AU) . |
| 64420/90 | 4/1991 | (AU) . |
| 71444/91 | 7/1991 | (AU) . |
| 62542/90 | 8/1991 | (AU) . |
| 72721/91 | 9/1991 | (AU) . |
| 648537 | 10/1991 | (AU) . |
| 76855/91 | 10/1991 | (AU) . |
| 75099/91 | 11/1991 | (AU) . |
| 78587/91 | 11/1991 | (AU) . |
| 13960/92 | 10/1992 | (AU) . |
| 21734/92 | 1/1993 | (AU) . |
| 22352/92 | 1/1993 | (AU) . |
| 28414/92 | 5/1993 | (AU) . |
| 1955047 | 5/1971 | (DE) . |
| 2703404 | 8/1977 | (DE) . |
| 2704461 | 8/1978 | (DE) . |
| 3912137 | 10/1990 | (DE) . |
| 0004500 | 10/1979 | (EP) . |
| 0055191 | 6/1982 | (EP) . |
| 0080846 | 6/1983 | (EP) . |
| 0 269 920 A1 | 6/1988 | (EP) . |
| 299017 | 1/1989 | (EP) . |
| 0370272 | 5/1990 | (EP) . |
| 0 458 250 A2 | 11/1991 | (EP) . |
| 460557 | 12/1991 | (EP) . |
| 1347895 | 1/1964 | (FR) . |
| 1536459 | 8/1968 | (FR) . |
| 1581775 | 9/1969 | (FR) . |
| 2320870 | 8/1975 | (FR) . |
| 1254930 | 11/1971 | (GB) . |
| 1309057 | 3/1973 | (GB) . |
| 1438648 | 6/1976 | (GB) . |

| | | |
|---|---|---|
| 1497821 | 1/1978 | (GB) . |
| 1512335 | 6/1978 | (GB) . |
| 1593072 | 7/1981 | (GB) . |
| 2068914 | 8/1981 | (GB) . |
| 2076381 | 12/1981 | (GB) . |
| 2096110 | 10/1982 | (GB) . |
| 2096114 | 10/1982 | (GB) . |
| 215091 | 9/1967 | (SE) . |

* cited by examiner

TAMPER EVIDENT CLOSURE

This application is a continuation of application Ser. No. 08/922,453 filed Sep. 3, 1997, which is a continuation of application Ser. No. 08/374,534 filed Mar. 7, 1995 now abandoned, which is a 371 of International Application No. PCT/AU93/00352, filed Jul. 14, 1993.

FIELD OF THE INVENTION

The present invention relates to closures for containers having an externally screw threaded neck and more particularly to such closures which are formed with a tamper evident band.

BACKGROUND ART

Manufacturers of foodstuffs, beverages, medicaments, dentifrice and the like are concerned to ensure that products they place on the market are not tampered with before being opened by the ultimate consumer of the goods. For this purpose it has become conventional to include in closures for such goods means which will indicate whether the closure has been tampered with before purchase. In the case of containers having an externally screw threaded neck it is common to provide the closure with a tamper evident band which engages behind a retaining flange formed on the neck of the container. The tamper evident band is joined to a depending skirt forming part of the closure by a number of frangible bridges. On application of the closure to the container the band is forced over the retaining flange, however, when the closure is unscrewed from the container the bridges are sheared as the band is trapped behind the retaining flange while the closure moves up the neck of the container.

While such tamper evident bands have been widely accepted there is a delicate balance between the two conflicting requirements. On the one hand, one must be able to apply the closures to containers at very high speed without inadvertently breaking the bridges, or breaking or deforming the band itself, or deleteriously affecting the seal between the closure and the container. On the other hand, the band must be sufficiently tightly secured behind the retaining flange and the bridges and/or the band must be sufficiently easily broken that the closure cannot be removed from the container without rupturing the bridges and/or the band.

Another problem is that an unauthorized person might attempt to remove the closure and tamper evident band, without damaging the band or frangible bridges, in order to contaminate or replace the container contents and then reapply the closure. Such operation might be attempted with the assistance of a thin device, such as a knife blade, wedged up between the tamper evident band and the neck of the container to which the closure has been applied. The devices might then be levered outwardly in order to expand the inner diameter of the band so that it may be passed back over the retaining flange of the container. In such a process the device will be edged around the circumference of the band so as to gradually ease the band over the retaining flange at a continuously lengthening portion of the band circumference.

Closures of the type mentioned above are used around the world in extremely large numbers. To be commercially acceptable such closures must be capable of being produced very rapidly in automated machinery. This itself may produce a conflict with the functionality of the closure and/or its tamper evident band.

The arrangement according to the present invention is designed to provide the public with an alternative form of closure having a tamper evident band.

DISCLOSURE OF THE INVENTION

The present invention in its broadest aspect consists in a closure for a container having an externally screw threaded neck, the closure comprising a top portion and a depending skirt which has on its internal surface a complementary screw thread, a free edge of the depending skirt being joined by a plurality of frangible bridges to a tamper evident band, the band comprising a generally cylindrical body portion and a segmented rib extending inwardly of the body portion and adapted to provide a lip to engage under a retaining flange extending outwardly from the neck of the container below the screw thread thereon, the rib having an upper side facing generally towards the top of the closure and an under side facing generally away from the top, the body portion being provided with projections or other localised areas of thickening to enhance the longitudinal stiffness of the body portion while still permitting it to expand radially as it is forced over the retaining flange on a container.

In a first preferred aspect the present invention consists in a closure for a container having an externally screw threaded neck, the closure comprising a top and a depending skirt which has on its internal surface a complementary screw thread, a free edge of the depending skirt being joined by a plurality of frangible bridges to a tamper evident band, the band comprising a generally cylindrical body portion and a continuous or segmented rib extending inwardly of the body portion and adapted to provide a lip to engage under a retaining flange extending outwardly from the neck of the container below the screw thread thereon, the rib having an upper side facing generally towards the top of the closure and an under side facing generally away from the top, the closure being characterized in that the upper side of the rib comprises a first surface contiguous with the body portion of the band, which surface slopes inwardly and downwardly from the top, and a second surface which is positioned radially inwardly from the first surface, the second surface having a slope angle more nearly normal to the longitudinal axis of the closure than the first surface is to that longitudinal axis.

In the prior art closures the upper side of the rib has always been linear in cross-section. The upper side has either lain in a plane normal to the longitudinal axis of the closure or it has been a simple frusto-conical surface inclined to that axis. In the former case it has been difficult to mold as the planar surface is normal to the direction in which the core of the mold must be withdrawn from the cap. In the latter case there is more likelihood of the rib being able to be forced upwardly over the flange on the container neck. The present invention has resolved these problems by providing the upper side of the rib with a compound surface having a more steeply angled radially outer surface which assists molding of the rib and, preferably, a substantially planar radially inner surface which increases the difficulty of removing the closure intact from a container. There is preferably a relatively clearly defined junction between the first and second surfaces on the upper side of the rib. However, they may merge together gradually such that the upper side of the rib is generally arcuate in cross-section. It has been found that improved resistance to removal of the closure from the container can be obtained in this way while facilitating the molding of the closure. This latter aspect is important as for economic reasons, it is necessary that the closures and their associated tamper evident bands must be capable of being molded at extremely high rates.

The first surface on the upper side of the rib preferably comprises from 25% to 75% and more preferably 45% to 55%, of the radial width of the upper side of the rib. The first surface preferably has a slope angle to a plane normal to the longitudinal axis of the closure of from 10° to 60°, more preferably 12° to 40° and most preferably 15° to 25°. The second surface on the upper side of the rib preferably comprises from 75% to 25% and more preferably 55% to 45% of the radial width of the upper side of the rib. The second surface preferably lies in a plane normal to the longitudinal axis of the closure or at an angle of up to 10° to that plane, most preferably it lies in that plane.

In carrying out the present invention it has been found that during the injection moulding of closures from an injection mould which defines a rib having an upper side comprising a first annular surface and a second annular surface the clear distinction between the first and second surfaces may be lost, or at least difficult to discern, in the moulded product. It is thought that this may be due to the second annular surface being distorted and dragged into a slope angle similar to that of the first surface as the closure is ejected from the mould. Despite the anomaly that the mould clearly displays the two surfaces but the moulded closure does not, it has been found that the closures moulded from such a mould show superior resistance to being tampered with as compared to similar closures moulded in a mould not defining the upper side of the rib as having first and second surfaces.

Therefore in another aspect the present invention consists in a closure for a container having an externally screw threaded neck, the closure comprising a top and a depending skirt which has on its external surface a complementary screw thread, a free edge of the depending skirt being joined by a plurality of frangible bridges to a tamper evident band, the band comprising a generally cylindrical body portion and a continuous or segmented rib extending inwardly of the body portion and adapted to provide a lip to engage under a retaining flange extending outwardly from the neck of the container below the screw thread thereon, the rib having an upper side facing generally towards the top of the closure and an under side facing generally away from the top, the closure being characterised in that the closure is formed by injection moulding from a synthetic plastics material in a mould which defines the upper side of the rib as comprising a first surface contiguous with the body portion of the band, which surface slopes inwardly and downwardly from the top, and a second surface which is positioned radially inwardly from the first surface, the second surface having a slope angle more nearly normal to the longitudinal axis of the closure than the first surface is to that longitudinal axis. The mould surface preferably has the other characteristics previously described as being preferred for the upper side of the rib itself.

In another embodiment of the invention the radially inner surface of the band is provided with an array of radially spaced apart inwardly extending projections positioned between the rib and a free edge of the band. The projections, or some of them, may, if desired, make contact with the under side of the rib across the longitudinal width of the band or they may stop short of the lower free edge of the band. They preferably are aligned parallel with the longitudinal axis of the closure but may be inclined to that axis. These inwardly extending projections make it difficult for a person deliberately trying to expand the diameter of the band and to ease it off the neck of the container intact by inserting a blade or other tool between the band and the container.

In a particularly preferred arrangement, the rib is segmented and alternate ones of the projections are spaced below the gaps between adjacent segments and are not connected to the rib. The remaining projections preferably abut at the upper ends with respective ones of the segments. These remaining projections preferably abut the segments at their respective mid-points. The projections are preferably inclined radially inwardly as they approach the rib, however they preferably do not extend inwardly from the radially inner surface of the body portion of the band as far as the rib does. The rib preferably extends inwardly beyond the projection by a distance substantially equal to the width of the second surface on the upper side of the rib.

The rib formed to engage with the retaining flange on the container may be continuous or segmented about the band, however if it is segmented it will still extend about a majority of the circumferential extent of the inside surface of the band. The rib segments, when present, are preferably evenly spaced about the inside circumference of the band and occupy at least 50%, preferably at least 65% and most preferably at least 80%, of the internal circumference of the band. The rib preferably has a sufficiently broad base where it joins the body portion of the band that the rib is resistant to flexing upwardly as it is forced past the retaining flange during application of the closure to a container.

Each of the rib segments is preferably formed with two substantially planar end surfaces which are inclined to the axis of the closure and face away from the closure top, i.e., they face in a direction that a mould core used to mould the closure was withdrawn. The planar end surfaces are also preferably inclined to a notional radial plane extending from the longitudinal axis of the closure to the end of the respective rib segment such that the ends are inclined to the skirt of the closure by an included angle that is less than the inclined angle that the respective notional plane makes with the skirt.

The tamper evident band is further preferably provided with areas of localised thickening which extend outwardly from an external surface of the body portion of the band. The areas of thickening further preferably extend parallel to the longitudinal axis of the closure and across the longitudinal width of the band.

The areas of outer thickening serve to reinforce and strengthen the tamper evident band. The reinforcement of the band preferably enhances the vertical stiffness of the band whilst retaining a sufficient flexibility to facilitate application of the closure to the container. The reinforcement also allows sufficient axial force to be applied to the free end of the band in order to successfully eject the closure from a core portion of a mould used in the closure production. The reinforcement of the band further reduces the possibility of the closure being tampered with and the band stretched in order that it may be eased back over the retaining flange on a container to which the closure has been applied.

The bridges are preferably evenly spaced about the circumference of the closure but may be optionally arranged in two groups which are diametrically opposed to one another. Each group may preferably occupy from one quarter to one third of the circumference of the closure while each of the spaced between the groups occupies from one quarter to one sixth of that circumference. Each group of bridges is preferably made up of from 4 to 10 bridges equally spaced apart within the group.

The individual bridges in each group may have an axis parallel to the axis of the closure. Preferably, however, the axis of each bridge is inclined to the axis of the closure, more preferably it is inclined such that when seen in side elevation the upper end of the bridge is inclined to the left relative to its lower end. This particularly preferred arrangement is predicated by the fact that most screw threads tighten in a clockwise direction. The preferred inclination of the bridges allows them to bend as the closure is screwed onto a container. This stabilizes the band and reduces the likelihood of it, or the bridges, breaking or distorting during application. Conversely this preferred inclination of the bridges means that as the closure is unscrewed the bridges are straightened out and this serves to concentrate the forces tending to rupture the bridge at the point of attachment of each bridge to the band and to the skirt.

The thread on the internal surface of the skirt of the closure is preferably formed of a series of thread segments arranged, starting from a first thread segment distal to the top, along a helical thread locus. Each of the thread segments, except the first, is preferably formed with two substantially planar end surfaces which are inclined to the axis of the closure and face away from the closure top, ie, they face in the direction that a mould core used to mould the closure was withdrawn. The term "substantially planar surface" is used to mean a surface which is actually planar or which is cured provided that it all faces in the defined direction. The first of the thread segments is preferably pointed at its end distal to its one adjacent thread segment to assist in mating the thread on the closure with a corresponding thread on the neck of a container.

The substantially planar ends of the thread segments are also preferably inclined to a notional radial planes of the closure extending from the longitudinal axis of the closure to the end of the respective thread segment such that the ends are inclined to the cylindrical skirt by an included angle that is less than the included angle that the respective notional radial plane makes with that skirt.

To assist in the venting of gas between the thread segment the spaces between the segment in adjacent turns of the thread are aligned. A groove may be provided on the inside surface of the skirt of the closure extending longitudinally thereof through the aligned spaces.

In another embodiment the present invention consists in an injection moulded article including a cylindrical wall having a thread formed on its radially inner surface, the thread being comprised of a plurality of segments arranged in spaced apart array along the helical locus of the thread, at least some of the thread segments terminating at at least one end in a substantially planar surface inclined to the axis of the thread and facing the direction in which a mould core used in the moulding of the article was withdrawn.

The closure is preferably formed with means for sealingly engaging with the container to prevent leakage therefrom. Any one of the large number of alternative sealing arrangements known may be used with the closure according to the present invention. These include integral sealing ribs or flanges, wadding or flowed-in gaskets.

The sealing arrangement preferably comprises an annular sealing rib which projects downwardly from an underside of the top of the closure, the rib including a first portion having a substantially cylindrical inner surface, the first portion being contiguous with the top and lying adjacent to the skirt of the closure and a second, frusto-conical, portion contiguous with an end of the first portion distal to the top and extending radially inwardly to terminate in a circular free edge, the first portion having an internal diameter at least equal to an external diameter of the neck of the container to which the closure is to be attached such that during threaded engagement of the closure with the neck, the second, frusto-conical, portion will be engaged by a free end of the neck and folded back against the substantially cylindrical inner surface of the first portion of the rib to form a gas-tight seal between at least an outer surface of the neck of the container and the closure.

The closure most preferably has a skirt having a substantially cylindrical form carrying on its outside surface a series of fine vertical ribs terminating at the lower edge of the skirt in a narrow circumferential rib. The frangible bridges are preferably considerably thinner in their radial dimensions than the skirt and the band and the inner surface of the bridges lie flush with the respective radially inner surfaces of the skirt and the band. The radially outer surface of the band is of a slightly smaller diameter than the skirt except in the areas of local thickening which project radially outwardly beyond the radial extent of the skirt.

In this most preferred embodiment of the inside surface of the skirt is preferably generally cylindrical with a helical array of thread segments extending radially inwardly of that surface. The thread segments are separated from one another by axially aligned spaces. The inside of the band is preferably defined by a smooth upper cylindrical surface above the rib of the same diameter as the inside surface of the skirt. The rib is preferably formed of rib segments in axial alignment with the thread segments on the inside surface of the skirt and with the spaces between the rib segments in axial alignment with the spaces between the thread segments. Below the rib the inside surface of the band is inclined downwardly and outwardly so that the band is a little thinner at its lower end than it is at the upper end. This inclined surface carries an array of projections which are axially aligned and of a thickness less than that of the rib segments. Alternate ones of the projections abut at their upper end against the mid point of one of the rib segments, while the other projections are each aligned with one of the spaces between the rib segments.

BRIEF DESCRIPTION OF THE DRAWINGS

A preferred embodiment of the present invention will now be described with reference to the accompanying drawings in which.

Figure 1:
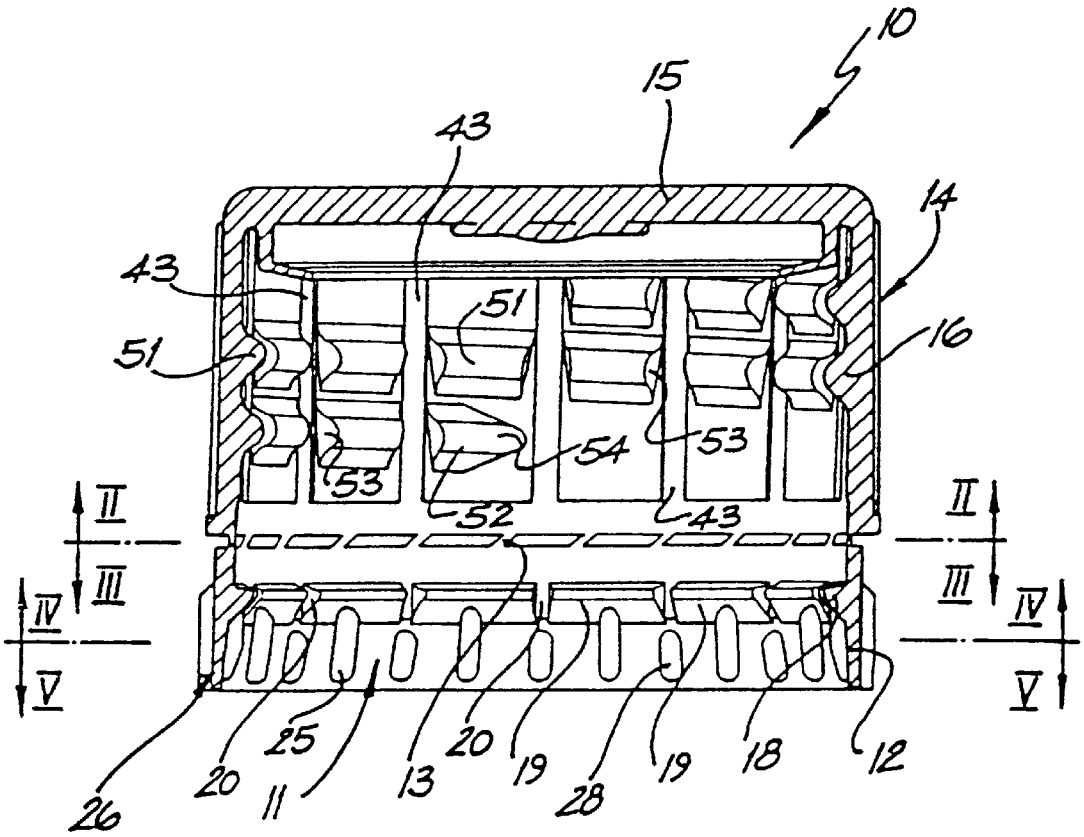
FIG. 1 is a diametric sectional view through one embodiment of the closure according to this invention.
Figure 2:
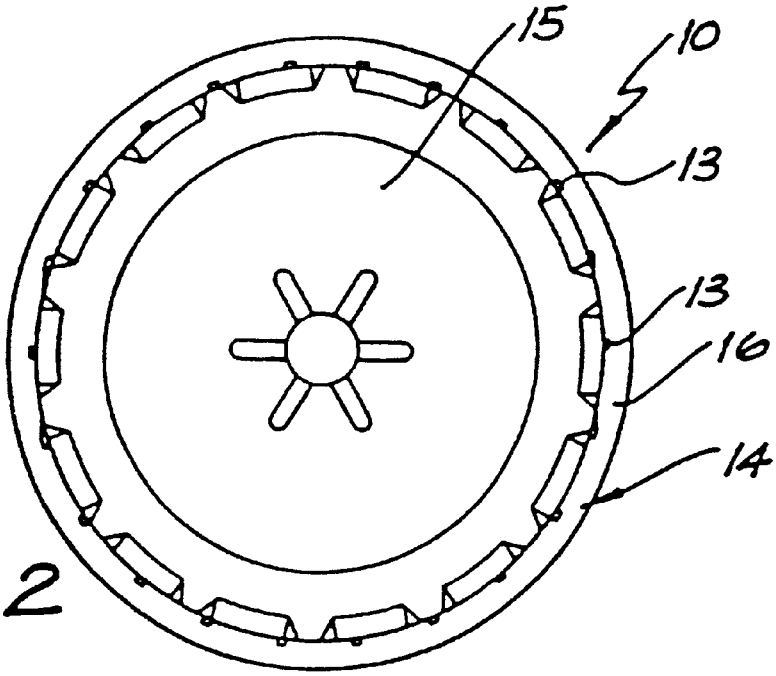
FIG. 2 is a view along section II—II of the closure of FIG. 1.
Figure 3:
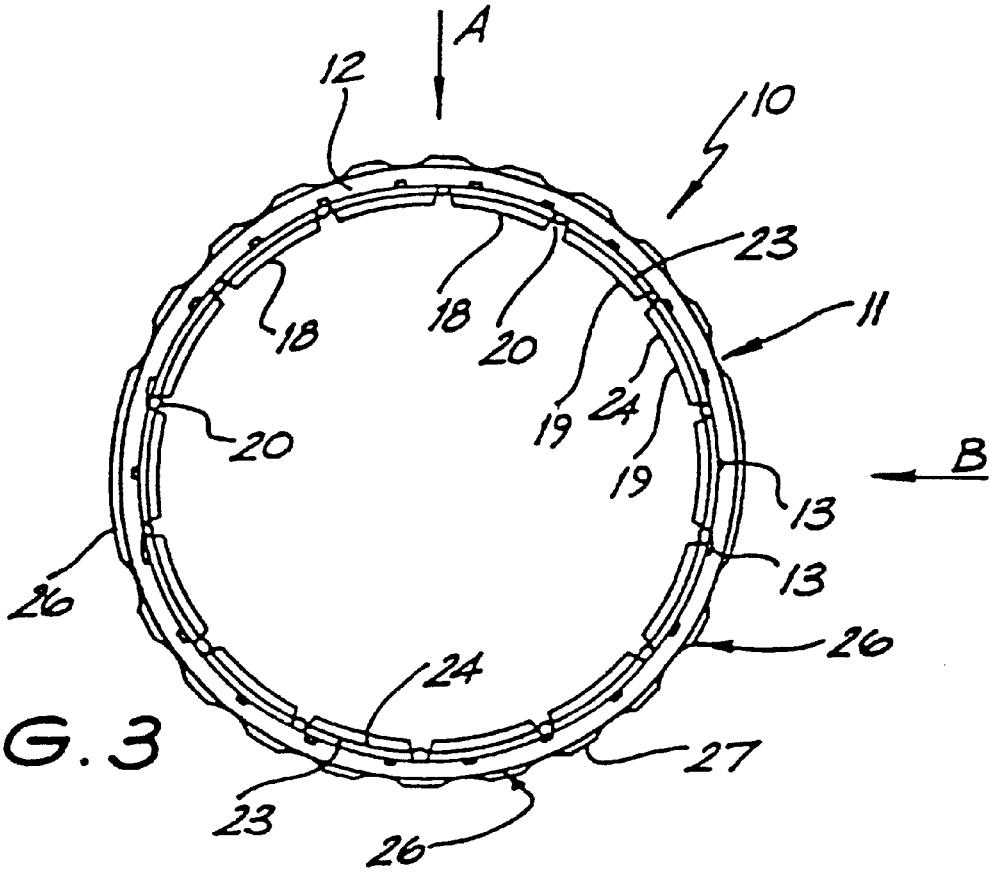
FIG. 3 is a view along section III—III of the closure of FIG. 1.
Figure 4:
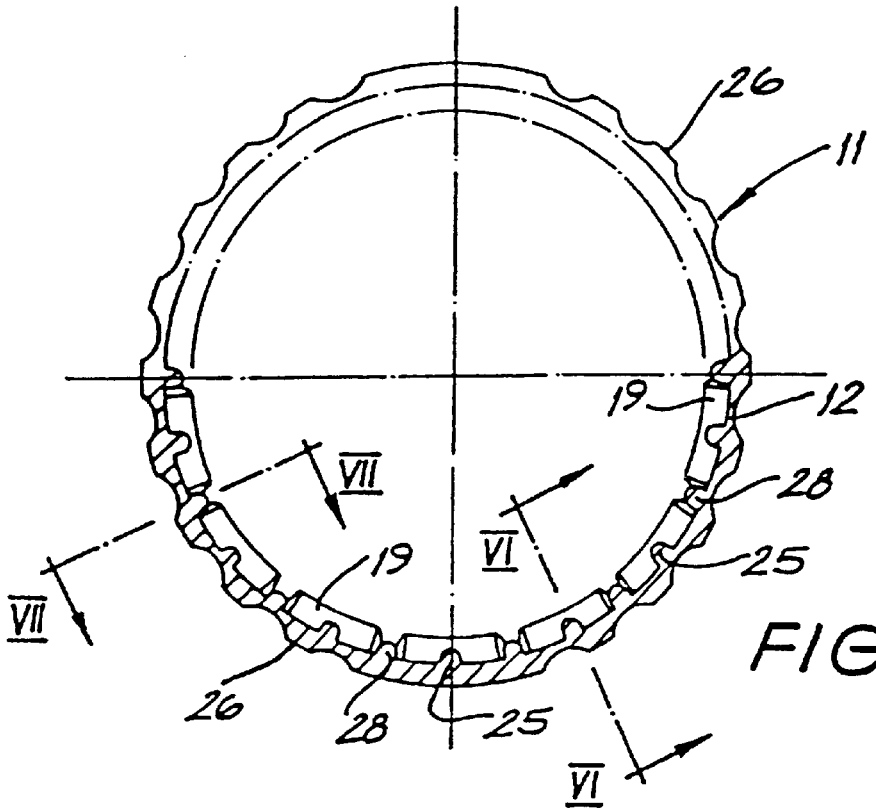
FIG. 4 is a view along section IV—IV of the closure of FIG. 1.
Figure 5:
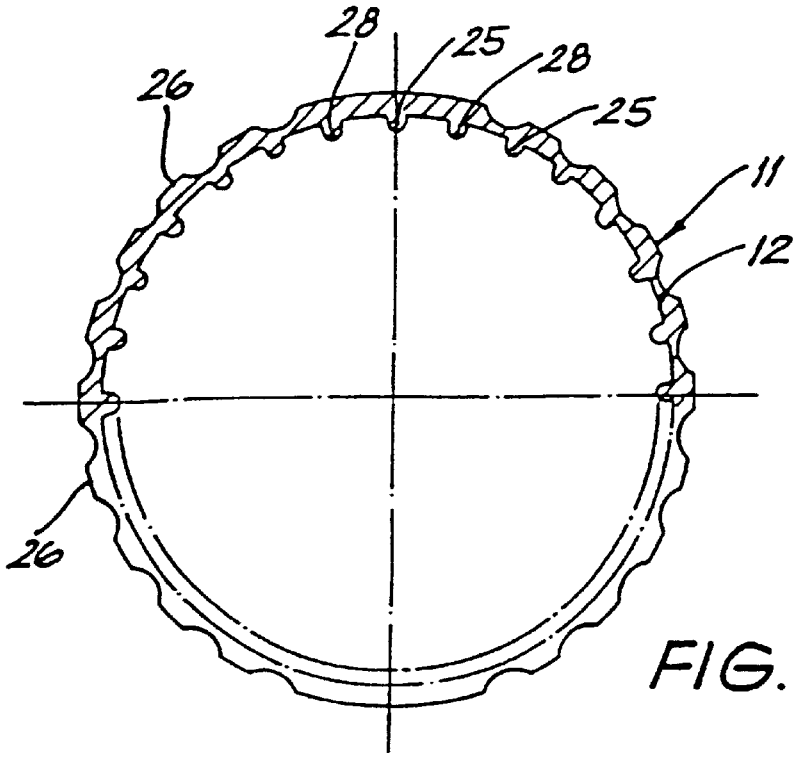
FIG. 5 is a view along section V—V of the closure of FIG. 1.
Figure 7:
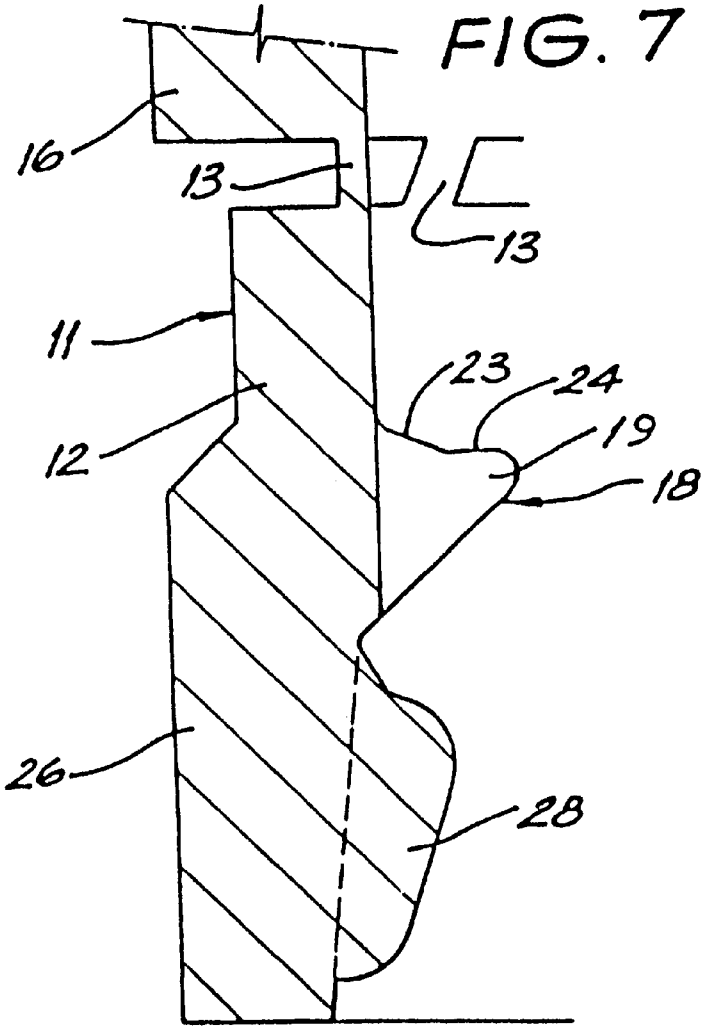
FIG. 7 is a view along section VII—VII of FIG. 4.
Figure 6:
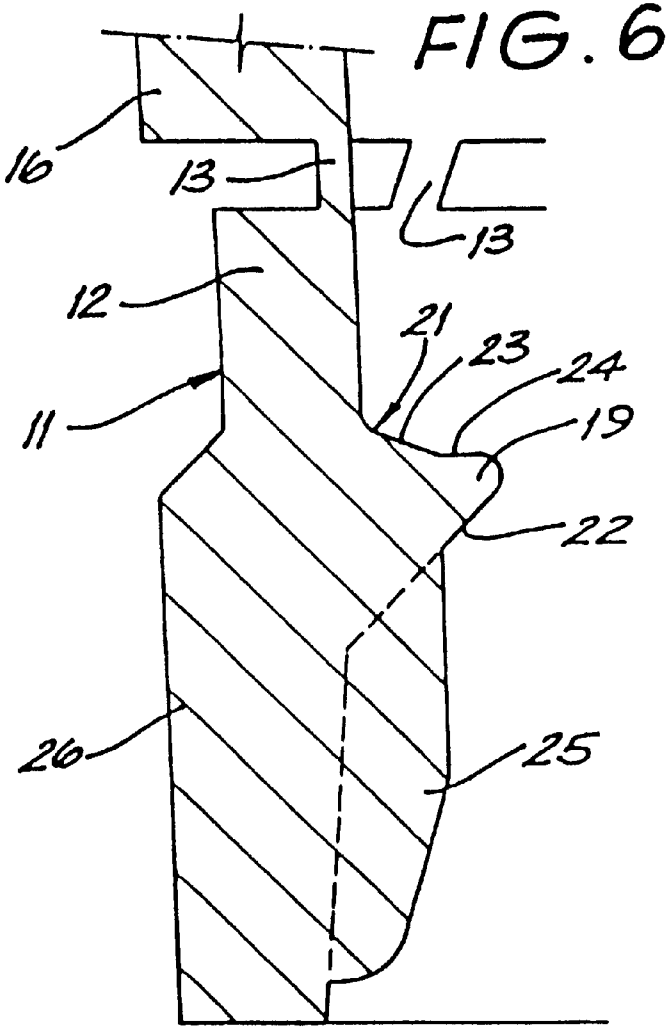
FIG. 6 is a view along section VI—VI of FIG. 4.
Figure 8:
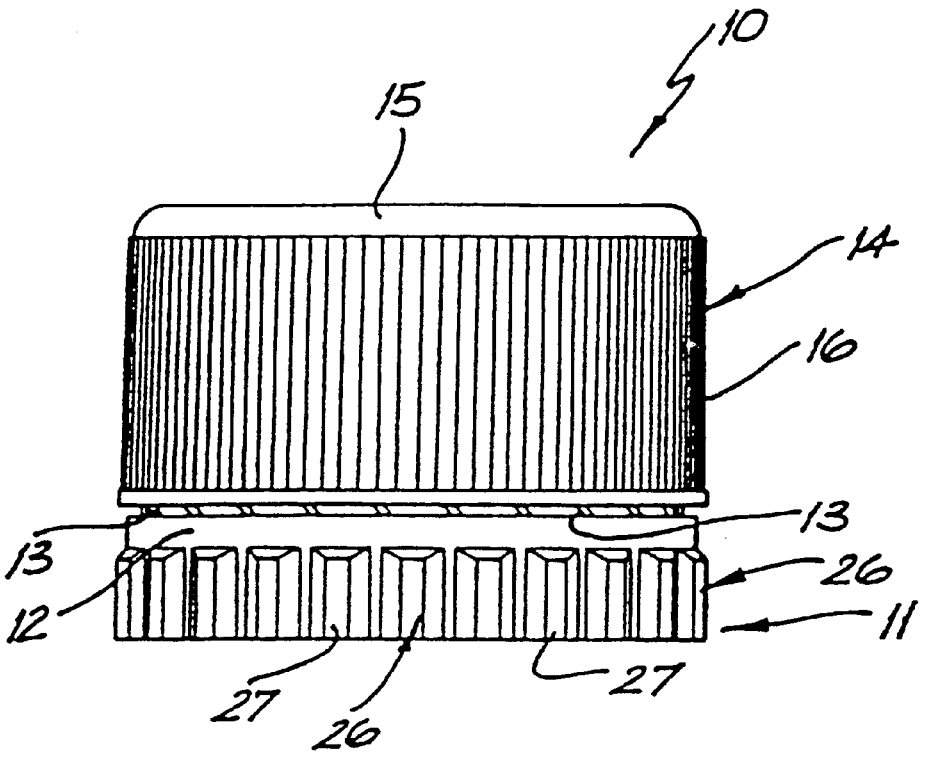
FIG. 8 is a side elevational view of the closure of FIG. 1 seen in the direction of arrow A of FIG. 3.
Figure 9:
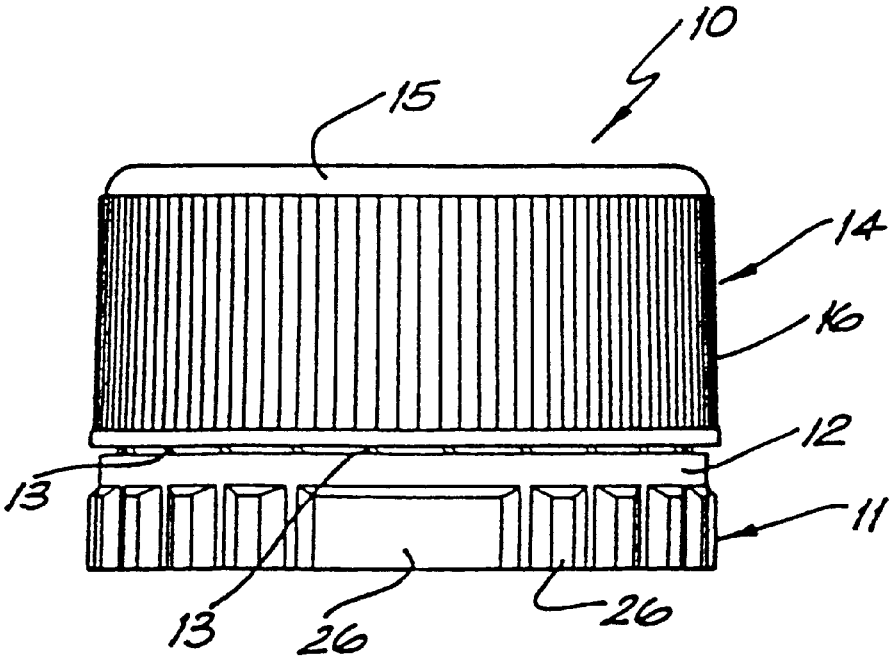
FIG. 9 is a side elevational view of the closure of FIG. 1 seen in the direction of arrow B of FIG. 3.

The tamper evident closure 10 includes a continuous tamper evident band 11 having a generally cylindrical body portion 12 attached by frangible bridges 13 to a cap portion 14 of the closure 10. The cap portion 14, frangible bridges 13 and tamper evident band 11 are formed integrally by injection molding from suitable material such as polyethylene or polypropylene. The cap portion 14 includes a circular top 15 and a depending skirt 16. The inside of the skirt 16 is screw threaded and adapted to be attached to containers commonly made from glass or a plastics material such as poly(ethylene terephthalate) (PET) which have an externally screw threaded neck.

Figure 10:
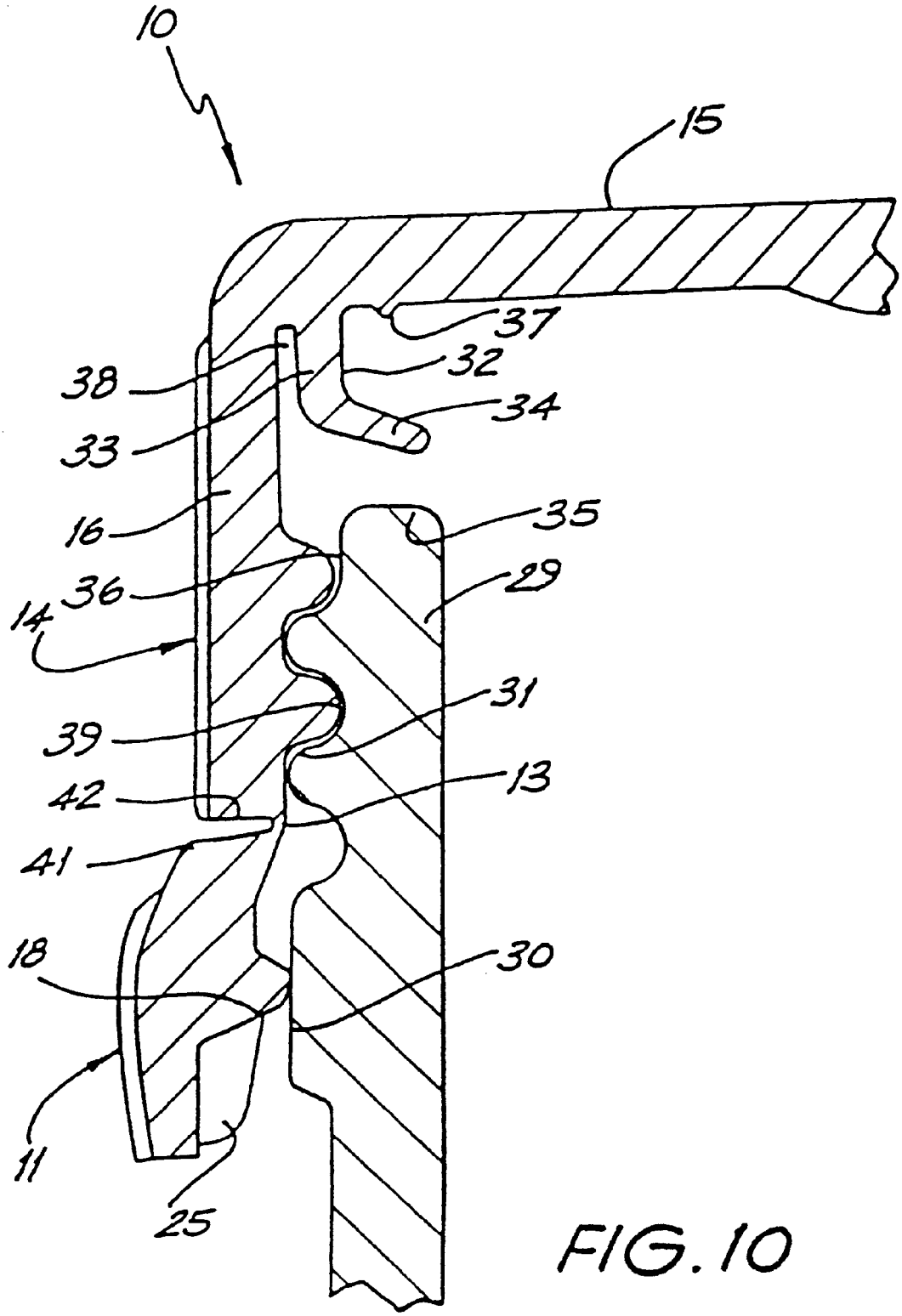
FIG. 10 is a longitudinal cross-sectional view of another embodiment of the closure on an enlarged scale and shows the closure in relation to a neck of a container, as the closure is screwed onto the container.
Figure 11:
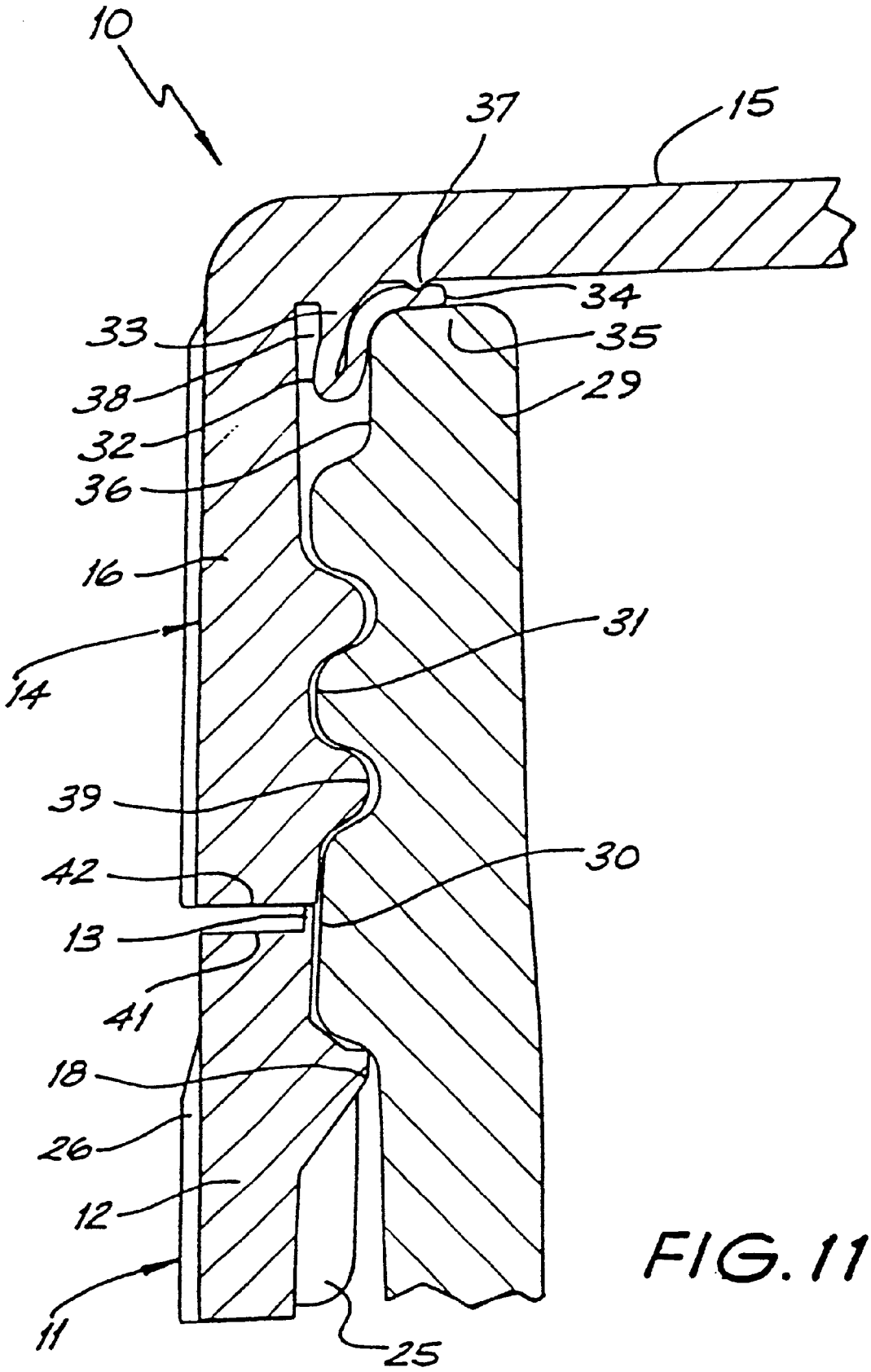
FIG. 11 is a longitudinal cross-sectional view of the closure of FIG. 10 with the closure sealingly engaged with the neck of the container.

The container 29 (a portion of which is shown in FIGS. 10 and 11) to which the closure 10 will be attached includes a continuous generally annular retaining flange 30 immediately below the screw thread 31 of the container 29 so as to form an outwardly radially directed lip. The band 11 includes a rib 18 about its inside surface being sized and shaped so as to provide an inwardly extending lip which will engage under the retaining flange 30 of the container 29 once the closure 10 is fully closed onto the container 29.

The rib 18 is made up of a series of rib segments 19 separated by short breaks 20 however the rib segments 19 constitute about 85% of the circumference of the band and act together as though the rib 18 were substantially continuous. The breaks 20 provide circumferential flexibility to the band and allow the rib 18 to pass over the retaining flange 30 without stress, sufficient to break the frangible bridges.

The rib 18 has an upper side 21 directed towards the top portion 15 and an under side 22 directed away from it. The upper side 21 includes a radially outer frusto-conical surface 23 and a radially inner annular surface 24. The annular surface 24 lies in a plane normal to a longitudinal axis of the closure 10 while the frusto-conical surface 23 is inclined inwardly and downwardly away from the top portion 15 and makes an angle of about 20° with the plane normal to the longitudinal axis of the closure. The outer frusto-conical surface 23 and the inner annular surface 24 each comprise about one half of the radial width of the upper surface of the rib 18. In use it is the annular surface 24 which engages under the flange 30 on the neck of the container 29 to which the closure 10 is attached. The presence of the frusto-conical surface 23 assists in the molding of the closure 10 as it prevents or at least substantially reduces the production of closures having deformed ribs 18. It also ensures rigidity of the rib 18 and thereby prevents distortion of the rib 18 as it is forced over the retaining flange 30 as the closure 10 is screwed down onto the container 29. The rib 18 is sufficiently robust that it can, on its own, withstand the forces applied to it during application to the container 29 and also prevents the cap 14 from being removed without breaking the frangible bridges 13 either by normal removal of the cap 14 or due to tampering with the container 29. It has been found that there is no deleterious effect in not having the annular surface 24 extend across the full width of the upper surface 21 of the rib 18.

Below the rib 18, and still on the inside surface of the body portion 12 of the band 11, is an arrangement of a plurality of inwardly extending projections 25 and 28, each having a long axis generally aligned with the longitudinal axis of the closure 10. The projections 25 and 28 extend radially inwardly from the inner surface of the body portion 12 sufficiently to come into contact with the retaining flange 30 during application of the closure 10 to the container 29 and once the container is capped to lie close to the outer neck surface of the container 29. Each alternate inwardly extending projection 28 is spaced below the break 20 in the substantially continuous rib 18 and is not connected to the rib 18. Each of the remaining inwardly extending projections 25 are connected at one end to the centre of a rib portion 19.

The radially inner free edge of each rib segment 19 projects inwardly well beyond the innermost extend of the projections 25 and 28 and must be sufficiently sturdy to be self-supporting during application of the closure 10 to the container 29 and in preventing the band 11 from riding up over the retaining flange 30.

The projections 25 and 28 prevent a person from introducing a device such as a knife blade radially inwardly of the body portion 12 of the band 11 and progressively moving the device circumferentially around the band 11 in an effort to gradually prise the rib 18 up and over its mating flange 30 on the container 29.

Along the outside surface of the band 11 are a number of reinforcements or thickenings 26. Each thickening 26 extends from a region adjacent the level of rib 18 to a region at the free end of the band 11. The thickenings 26 in conjunction with the inwardly extending projections 25 and 28 strengthen the band 11 and thus enhance the vertical stiffness of the band 11 whilst retaining a sufficient horizontal or radial flexibility. This also allows sufficient axial force to be applied to the free end of the closure 10 to successfully eject the closure 10 from a core portion of a mold used in its production.

The outer surfaces of the thickenings 26 present substantially flat lands 27 which lie radially just outside the radial extend of the rear of the closure 10 to allow the land to be mechanically gripped or otherwise contacted without necessarily contacting the skirt.

The closure 10 is formed with a sealing arrangement which includes a concentric annular rib 32 which extends from the underside of the top portion 15 of the cap portion 14. The annular sealing rib 32 includes a first or root portion 33 which extends downwardly from the top portion 15 approximately parallel to the skirt 16 with a second portion 34 which, prior to engagement with the neck of the container 29, tapers inwardly and away from the skirt 16.

The second portion 34 of the rib 32 contacts the end 35 of the container 29 as the closure 10 is being screwed onto the container 29, and the second portion 34 is caused to fold up against the surface of the first portion 33. Thus there is formed a continuous gas tight seal between the closure 10 and the container 29 extending up the side wall 36 of the container 29 to the end 35 of the container 29.

As the closure 10 is screwed onto the neck of the container 29, the second portion 34 of the sealing rib 32 is deformed by being bent towards the top 15. The deformation continues and contact is made between the second portion 34 and an inner rib 37 on the inside surface of the top 15. The inner rib 37 in fact is not essential to the invention and can be dispensed with if desired.

Once the second portion 34 has contacted the top portion 15, further movement attaching the closure 10 will press and grip the contacting part of the second portion 34 between the container end 35 and the top portion 15. As the movement attaching the closure 10 continues, it tends to pinch the free edge of rib 32 between the container 29 and the top portion 15 and to "pull" the first portion 33 of the annular rib 32 tightly in towards the container end 35 to produce a tight seal about the curved edge surface of the container 29 extending from its extreme end annular surface 35 down the side wall 36.

As the closure 10 is screwed onto the neck of the container 29, the screw thread 31 also engages the thread 39 on the interior surface of the skirt 16. As the closure 10 moves down the neck of the container 29 the frangible bridges 13 form an annular weak zone which allows the rib 18 to diametrically expand over the retaining flange 30 of the container 29.

In this embodiment the frangible bridges are equally spaced about the circumference of the closure 10 and the axis of each frangible bridge 13 is inclined such that when seen in side elevation the upper end of each bridge 13 is inclined to the left relative to its lower end. The bridges 13, therefore, bend as the closure 10 is screwed clockwise onto the container 29. As the rib 18 expands over the flange 30, the lower edge 42 of the skirt 16 and the upper edge 41 of the band 11 have room to flex towards each other whilst still having the bridges 13 therebetween. This stabilises the band 11 and reduces the likelihood of the bridges 13 breaking during application.

Once the rib 18 has passed over and engaged under the flange 30, the frangible bridges 13 return to their extended orientation (FIG. 11). As the closure 10 begins to be unscrewed from the neck of the container 29, the rib 18 detains the band 11 under the flange 30. As the closure 10 is unscrewed further, the bridges 13 are straightened which serves to concentrate the forces tending to rupture the bridges 13 at the point of attachment of each bridge 13 to the band 11 and to the skirt 16.

As is best seen in FIG. 1, inside the skirt 16 is a thread made up of a plurality of thread segments 51 arranged in spaced apart array along the locus of the thread. Each thread segment, except the first segment 52, is bounded at each end by a planar surface 53. Each of the planar surfaces 53 is inclined to the longitudinal axis of the closure 10 so that it faces away from the top 15. Each planar surface 53 is also inclined relative to a notional radial plane extending from the axis of the closure 10 to the planar surface 53 in question such that the minimum included angle between the planar surface 53 and the skirt 16 is acute and is less than the angle that a notional radial plane makes with the skirt 16.

The first thread segment 52 is formed with a planar surface 53 on its trailing edge, however it is formed with a point 54 on its leading edge to assist in mating the thread on the closure 10 with a corresponding thread on the neck of the container 29.

The thread segments 51 in each turn of the thread are aligned as are the spaces between them. A groove 43 is formed on the inside surface of the skirt 16 in each of the aligned spaces between adjacent thread segments 51. The grooves 43 serve to assist in venting gas from a carbonated beverage container as the closure 10 is unscrewed.

The end faces of each of the rib segments 19 are each angled as has been described in respect of thread segments. This reduces the likelihood of the ends of the rib segments 19 being damaged as the closure 10 is ejected from a mould.

The closure 10 is moulded on a mould core which defines, inter alia, the inside surface of the skirt 16, the thread segments 51 and the grooves 43. It has been found that by forming the thread segments 51 with planar surfaces 53, damage to the thread segments 51 upon theclosure 10 being ejected off the mould core has been significantly reduced as compared with forming each of the thread segments with a pointed end similar to point 54.

Figure 12:
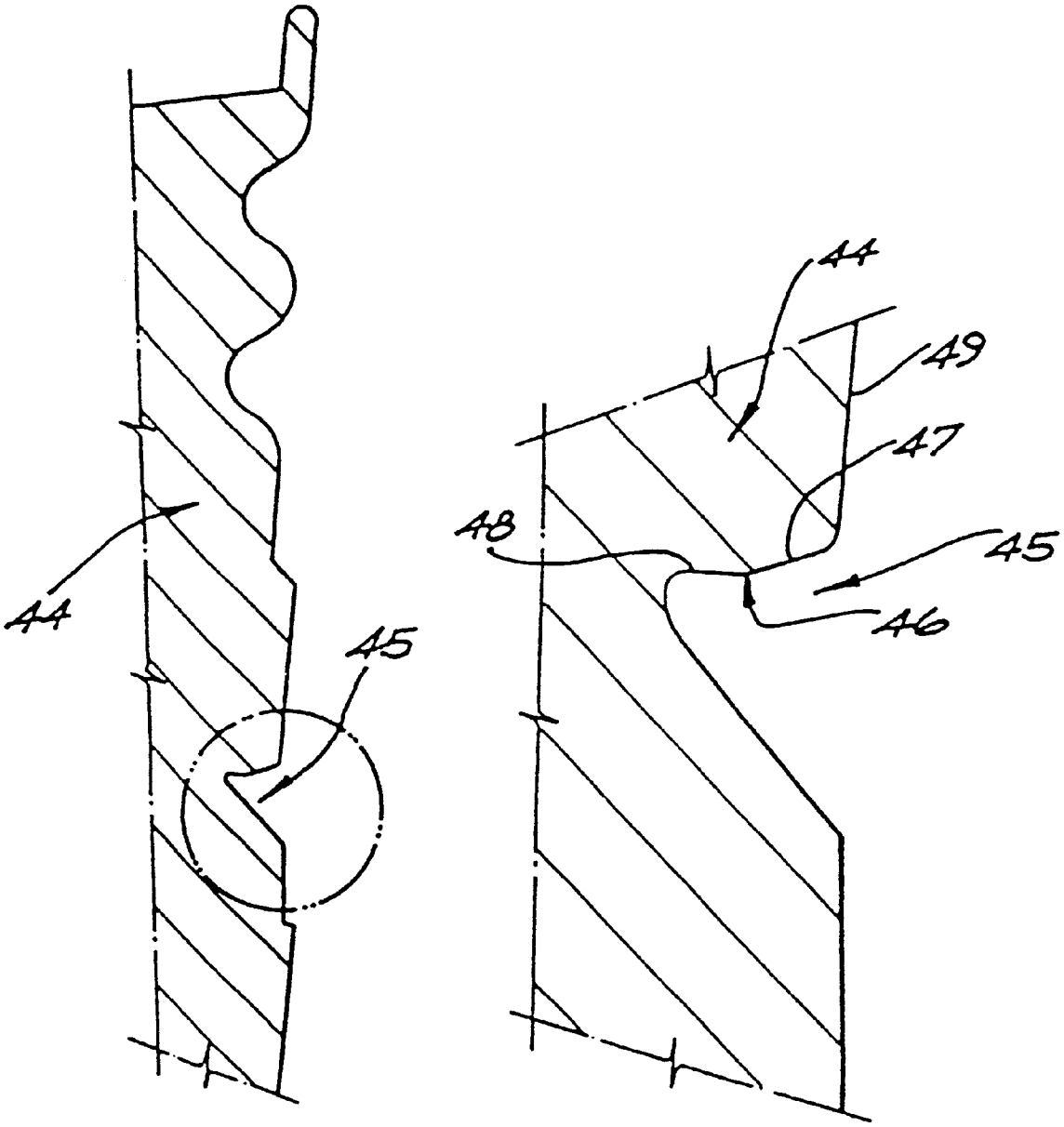
FIG. 12 is a vertical sectional view through a part of a mould used for the injection moulding of closures according to the present invention with the area defining the rib being also shown as an enlarged seal.

FIG. 12 depicts that part of a mould 44 used to mould the rib segments 19. It can be seen that the mould defines a recess 45 corresponding in cross-sectional shape to the desired slope of the rib segments 19 and is divided into an outer first surface 47 and an inner second surface 48. The first surface 47 is contiguous with a cylindrical surface 49 of the mould which defines the inside surface of the band 11. This first surface 47 is inclined to a plane normal the axis of the mould by an angle of 20°. The second surface 48 lies in the plane normal to the axis of the mould.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A method of forming a closure, the closure comprising a top portion, a skirt portion depending from the top portion, and a tamper-evident band portion extending from the skirt portion by connection through frangible bridges, the band portion comprising a generally cylindrical body portion and a rib extending radially inwardly of the body to provide a lip, the rib having an upper side facing generally towards the top portion of the closure and an underside facing generally away from the top portion, the upper side of the rib comprising a first surface contiguous with the body portion of the band, which surface slopes inwardly and downwardly away from the top portion, and a second surface which extends radially inward from the inner terminus of the first surface and has a slope angle substantially normal to the skirt portion of the closure, said method comprising the step of injection molding a synthetic plastics material into a mold.

2. The method of claim 1 wherein the synthetic plastics material is polyethylene.

3. The method of claim 1 wherein the synthetic plastics material is polypropylene.

4. A container having a screw threaded neck and a retaining flange below the threaded portion of the neck, to which is connected a closure, the closure comprising a top portion, a skirt portion depending from the top portion, which skirt portion has a screw thread complementary to the threaded portion of the neck of the container, and a tamper-evident band portion extending from the skirt portion by connection through frangible bridges, the band portion comprising a generally cylindrical body portion and a rib extending radially inwardly of the body to provide a lip to engage under the retaining flange of the container, the rib having an upper side facing generally towards the top portion of the closure and an underside facing generally away from the top portion, the upper side of the rib comprising a first surface contiguous with the body portion of the band, which surface slopes inwardly and downwardly away from the top portion, and a second surface which extends radially inward from the inner terminus of the first surface and has a slope angle substantially normal to the skirt portion of the closure.

5. The container of claim 4 wherein the container is a carbonated beverage container.

6. The container of claim 4 wherein the container is formed from polyethylene terephthalate (PET).

7. The container of claim 4 wherein the container is formed from glass.

8. A mold for use in the injection molding of a closure from a synthetic plastics material, the closure comprising a top portion, a skirt portion depending from the top portion, and a tamper-evident band portion extending from the skirt portion by connection through frangible bridges, the band portion comprising a generally cylindrical body portion and a rib extending radially inwardly of the body to provide a lip, the rib having an upper side facing generally towards the top portion of the closure and an underside facing generally away from the top portion, the upper side of the rib comprising a first surface contiguous with the body portion of the band, which surface slopes inwardly and downwardly away from the top portion, and a second surface which extends radially inward from the inner terminus of the first surface and has a slope angle substantially normal to the skirt portion of the closure, the mold defining a recess corresponding in cross-sectional shape to the rib of the closure, the recess defining a first outer surface contiguous with a cylindrical surface of the mold, the first outer surface being inclined to a plane normal to the axis of the mold by an angle, and a second inner surface that extends radially from the terminus of the first outer surface and lies in a plane normal to the axis of the mold.

9. A method of forming a closure, the closure comprising a top portion, a skirt portion depending from the top portion, and a tamper-evident band portion extending from the skirt portion by connection through frangible bridges, the band portion comprising a generally cylindrical body portion having a terminal free edge and segmented ribs extending radially inwardly of the body to provide a lip, the segmented ribs being disposed annularly on the internal circumference of the band, the combined circumferential length of the segmented ribs being equal to at least 50% of the internal circumference of the band and the segmented ribs being separated from each other by a gap, each rib segment having an upper side facing generally towards the top portion of the closure and an underside facing generally away from the top portion, and the inner surface of the band having a plurality of radially inward projections extending from above the free edge of the band to below the inner free edge of the lip, said method comprising the step of injection molding a synthetic plastics material into a mold.

10. The method of claim 9 wherein the outer surface of the band portion has means for imparting longitudinal rigidity to the band portion while still permitting the band to extend radially outward as the band portion is moved over the neck of the container.

11. The method of claims 9 or 10 wherein the synthetic plastics material is polyethylene.

12. The method of claims 9 or 10 wherein the synthetic plastics material is polypropylene.

13. A container having a screw threaded neck and a retaining flange below the threaded portion of the neck, to which is connected a closure, the closure comprising a top portion, a skirt portion depending from the top portion, which skirt portion has a screw thread complementary to the threaded portion of the neck of the container, and a tamper-evident band portion extending from the skirt portion by connection through frangible bridges, the band portion comprising a generally cylindrical body portion having a terminal free edge and segmented ribs extending radially inwardly of the body to provide a lip to engage under the retaining flange of the container, the segmented ribs being disposed annularly on the internal circumference of the band, the combined circumferential length of the segmented ribs being equal to at least 50% of the internal circumference of the band and the segmented ribs being separated from each other by a gap, each rib segment having an upper side facing generally towards the top portion of the closure and an underside facing generally away from the top portion, and the inner surface of the band having a plurality of radially inward projections extending from above the free edge of the band to below the inner free edge of the lip.

14. The container of claim 13 wherein the outer surface of the band portion of the closure has means for imparting longitudinal rigidity to the band portion while still permitting the band to extend radially outward as the band portion is moved over the neck of the container.

15. The container of claims 13 or 14 wherein the container is a carbonated beverage container.

16. The container of claims 13 or 14 wherein the container is formed from polyethylene terephthalate (PET).

17. The container of claims 13 or 14 wherein the container is formed from glass.

18. A mold for use in the injection molding of a closure from a synthetic plastics material, the mold comprising a plurality of surfaces configured to produce in combination a closure comprising a top portion, a skirt portion depending from the top portion, and a tamper-evident band portion extending from the skirt portion by connection through frangible bridges, the band portion comprising a generally cylindrical body portion having a terminal free edge and segmented ribs extending radially inwardly of the body to provide a lip, the segmented ribs being disposed annularly on the internal circumference of the band, the combined circumferential length of the segmented ribs being equal to at least 50% of the internal circumference of the band and the segmented ribs being separated from each other by a gap, each rib segment having an upper side facing generally towards the top portion of the closure and an underside facing generally away from the top portion, and the inner surface of the band having a plurality of radially inward projections extending from above the free edge of the band to below the inner free edge of the lip being characterized in that alternate radially inward extending projections are disposed between and below the gaps.

19. The mold of claim 18 for use in the injection molding of the closure from a synthetic plastics material and further wherein the outer surface of the band portion of the closure has means for imparting longitudinal rigidity to the band portion while still permitting the band to extend radially outward as the band portion is moved over the neck of the container.

* * * * *